US010221731B2

(12) United States Patent
Bruestle

(10) Patent No.: US 10,221,731 B2
(45) Date of Patent: Mar. 5, 2019

(54) PAN SYSTEM FOR AN ENGINE HOUSING STRUCTURE OF AN INTERNAL COMBUSTION ENGINE

(71) Applicant: Neander Motors AG, Kiel (DE)

(72) Inventor: Claus Bruestle, Nordheim (DE)

(73) Assignee: Neander Motors AG, Kiel (DE)

( * ) Notice: Subject to any disclaimer, the term of this patent is extended or adjusted under 35 U.S.C. 154(b) by 56 days.

(21) Appl. No.: 15/067,977

(22) Filed: Mar. 11, 2016

(65) Prior Publication Data

US 2016/0265402 A1 Sep. 15, 2016

(30) Foreign Application Priority Data

Mar. 14, 2015 (DE) ..... 10 2015 003 282

(51) Int. Cl.
*F01M 11/00* (2006.01)
*F01M 5/00* (2006.01)
*F01M 11/04* (2006.01)

(52) U.S. Cl.
CPC ..... *F01M 11/0004* (2013.01); *F01M 5/002* (2013.01); *F01M 2011/0025* (2013.01);
(Continued)

(58) Field of Classification Search
CPC ..... F01M 11/0004; F01M 5/002; F01M 2011/0025; F01M 2011/0066;
(Continued)

(56) References Cited

U.S. PATENT DOCUMENTS 2,577,188 A * 12/1951 Hall ..... F01M 5/002 184/104.2
3,688,871 A * 9/1972 Krestan ..... F01M 11/0004 184/106
(Continued)

FOREIGN PATENT DOCUMENTS

DE 27 45 931 A1 4/1978
DE 31 42 327 A1 5/1983
(Continued)

OTHER PUBLICATIONS

Machine translation of EP1264970, Maute et al., Dec. 11, 2002, obtained from http://worldwide.espacenet.com/, pp. 1-8.*
(Continued)

*Primary Examiner* — Grant Moubry
(74) *Attorney, Agent, or Firm* — Crowell & Moring LLP

(57) ABSTRACT

A pan system suitable for an engine housing structure has trough-shaped inner and outer pans with bottoms and upright walls. The inner pan accommodates engine oil. The outer pan bottom and upright walls run at least in certain areas at a distance from the bottom and walls of the inner pan, forming a channel-like intermediate space containing engine for affecting the temperature of the inner pan. Fins are provided on the inner walls and the outer walls. The bottoms of the inner and outer pans interact through a supporting system. Preferably, the inner and outer pans are made of metallic material and the inner pan is provided at least on one inner side of the bottom and upright walls with a cooling fin system that optimizes heat transfer. The upright walls of the inner and outer pans are connected to the engine housing structure.

15 Claims, 2 Drawing Sheets

(52) U.S. Cl.
CPC ..... *F01M 2011/0066* (2013.01); *F01M 2011/0087* (2013.01); *F01M 2011/0416* (2013.01)

(58) Field of Classification Search
CPC ..... F01M 2011/0087; F01M 2011/0416; F01P 3/00; F01P 3/12; F01P 9/00; F01P 11/00
USPC ..... 123/195 C, 196 R, 198 E
See application file for complete search history.

(56) References Cited

U.S. PATENT DOCUMENTS 3,817,354 A * 6/1974 Meiners ..... F01M 5/002 165/164
4,150,655 A 4/1979 Gaggiano et al.
4,770,276 A * 9/1988 Takubo ..... F01M 11/0004 123/195 C
5,452,693 A * 9/1995 Clark ..... F01M 11/0004 123/195 C
5,465,692 A * 11/1995 Uraki ..... F01M 11/0004 123/195 C
5,852,991 A * 12/1998 Yamamura ..... F01M 11/0004 123/195 C
6,234,136 B1 * 5/2001 Choi ..... F01M 11/0004 123/195 C
6,925,970 B2 * 8/2005 Liu ..... F01P 1/02 123/195 R
7,069,899 B1 * 7/2006 Okuda ..... F01M 11/0004 123/195 C
7,131,421 B2 * 11/2006 Hada ..... F01M 11/0004 123/196 R
7,637,337 B2 * 12/2009 Stranges ..... F01M 11/0004 180/69.1
8,020,666 B2 * 9/2011 Yamashita ..... F01M 11/0004 184/106
8,904,988 B1 * 12/2014 Bryde ..... F01M 11/064 123/195 C
2002/0170524 A1 * 11/2002 Lawrence ..... F01M 11/03 123/196 R
2008/0066982 A1 * 3/2008 Kobayashi ..... F01M 5/001 180/69.1
2008/0083586 A1 * 4/2008 Kobayashi ..... F01M 5/02 184/6.4
2010/0199942 A1 8/2010 Yamada et al.

FOREIGN PATENT DOCUMENTS

DE 10 2006 019020 A1 10/2007
DE 102008059619 A1 * 2/2010 ..... F01M 11/0004
EP 1 264 970 A1 12/2002
EP 1 264 970 B1 4/2005
EP 2 166 201 A1 3/2010
FR 2 721 975 A1 1/1996
JP S63-75550 * 5/1988 ..... F02F 7/00

OTHER PUBLICATIONS

German Office Action issued in counterpart German Application No. 10 2015 003 282.8 dated Feb. 11, 2016 (seven (7) pages).
German Office Action issued in counterpart European Application No. 16000593 dated Jul. 28, 2016 (six (6) pages).

* cited by examiner

PAN SYSTEM FOR AN ENGINE HOUSING STRUCTURE OF AN INTERNAL COMBUSTION ENGINE

CROSS REFERENCE TO RELATED APPLICATIONS

This application claims priority under 35 U.S.C. § 119 from German Patent Application No. 10 2015 003 282.8, filed Mar. 14, 2015, the entire disclosure of which is herein expressly incorporated by reference.

BACKGROUND AND SUMMARY OF THE INVENTION

The invention relates to a pan system for an engine housing structure of an internal combustion engine which has inner and outer pans with bottoms and upright walls which are placed inside one another and are trough-shaped in cross section. The inner pan accommodates lubricating oil of the internal combustion engine and the outer pan with the bottom and the upright walls runs at least in certain areas at a distance from the bottom and the walls of the inner pan so as to result in a channel-like intermediate space which contains cooling liquid of the internal combustion engine for affecting the temperature of the inner pan. Fins are provided on the inner walls and the outer walls, and the inner pan and the outer pan interact through the medium of a supporting system.

From EP 1 264 970 B1, an oil pan is known which is double-walled in certain areas and has an inner shell made of plastic and an outer shell made of metal. A coolant for the inner shell, which accommodates lubricating oil, flows in the space formed by the inner shell and the outer shell. The inner shell has supporting ribs which rest against a bottom and upright walls of the inner shell. Furthermore, cooling fins are provided on an outer side of a bottom of the outer shell. In addition, a heat exchanger, which affects the heat between coolant and ambient air, is integrated in the oil pan.

FR 2 721 975 A1 describes an oil pan which includes a plurality of cooling channels on its underside. The cooling channels are connected to the cooling circuit of an internal combustion engine and medium of the cooling circuit flows through them. Fins are provided in the oil pan and the cooling channels.

An internal combustion engine with a double wall can be seen from DE 31 42 327 A1. Its walls form a hollow space through which a coolant flows between inlet and outlet openings. The coolant flowing through the hollow space acts as a wall thickening for insulating air-borne noise.

The object of the invention is to design a pan system for an internal combustion engine for accommodating lubricating oil to be cooled by means of cooling liquid, which pan system can be combined with an engine housing of the internal combustion engine in a simply designed, functionally optimized and easy manner.

According to the invention, this object is achieved a pan system for an engine housing structure of an internal combustion engine which has two pans (inner and outer) with bottoms and upright walls which are placed inside one another and are trough-shaped in cross section. The inner pan accommodates lubricating oil of the internal combustion engine and the outer pan with the bottom and the upright walls runs at least in certain areas at a distance from the bottom and the walls of the inner pan so as to result in a channel-like intermediate space which contains cooling liquid of the internal combustion engine for affecting the temperature of the inner pan. Fins are provided on the inner walls and the outer walls, and the inner pan and the outer pan interact through the medium of a supporting system. The inner pan and the outer pan are made of metallic material and the inner pan is provided at least on one inner side of the bottom and the upright walls with a cooling fin system for optimizing the heat transfer. The supporting system is effective between the bottoms of the inner pan and the outer pan. The upright walls of the inner pan and of the outer pan are connected to the engine housing structure.

The advantages mainly achieved with the invention are to be seen in that the inner wall and the outer wall of the pan system can be constituted in the intended manner with defined design effort. In doing so, the inner walls and the outer walls are made of metal, preferably of lightweight metal, and have an advantageous strength and thermal conductivity. Furthermore, the particularly ingenious cooling fin system, above all on the bottom and the upright walls of the inner wall, enables an optimized heat transfer between the inner pan, which is exposed to the coolant of the internal combustion engine, and the lubricating oil of the the internal combustion engine. The supporting system between the bottoms of the inner pan and the outer pan and also the chosen connection of the upright walls of the latter mentioned pans to the engine housing structure of the internal combustion engine are also to be emphasized in this regard. For appropriate applications, the cooling fin system can also be provided on the outer side of the upright walls of the inner pan.

The supporting system is therefore exemplary in design, as it has a supporting pin with a mounting bolt on the bottom of the inner pan which rests on a mounting bush of the bottom of the outer pan, wherein the mounting bolt is actively connected to a hole in the mounting bush. The supporting system is functionally expanded in that the mounting bolt is provided with an oil drain screw. Cleverly solved from a design point of view is that free ends of the inner pan and the outer pan are formed as supports which interact with counter supports of a connecting housing of the engine housing structure under defined supporting load. The last solution is further optimized in that the supports and the counter supports are bounded by a common plane between the inner pan and the outer pan or the connecting housing.

The cooling fin system sets standards in that it includes a plurality of bottom cooling fins, which are uniformly distributed for example, on an inner side of the bottom as well as wall cooling fins on an inner side of the upright walls of the of the inner pan. The bottom cooling fins and the wall cooling fins are aligned substantially perpendicular to the bottom and the upright walls of the inner pan. At the same time, the fact that at least one of the bottom cooling fins extends over a defined partial height of a total height of the upright walls of the inner pan contributes to the particular efficiency of the cooling fin system. This is assisted in that the partial height is defined, for example, by the product 0.5×total height of the upright walls of the inner pan. Improving the effect is also that, on the one hand, at least one part of the wall cooling fins extends approximately over the partial height of the bottom cooling fins and, on the other hand, that a first length of the wall cooling fins on the outer side of the upright walls of the inner pan is approx. 12 to 15 mm. Also contributing to efficiency optimization are that, on the one hand, a second length of the wall cooling fins on the inner side of the upright walls of the inner pan is defined by the factor 0.8 to 0.9× the first length and, on the other hand, the distance at least between a part of the bottom cooling fins and the wall cooling fins is defined by the product 2× the first length of the wall cooling fins on the outer side of the upright walls of the inner pan. Finally, it is also of advantage when the thickness of at least one part of the bottom and wall cooling fins is between 1.5 and 2.5 mm.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
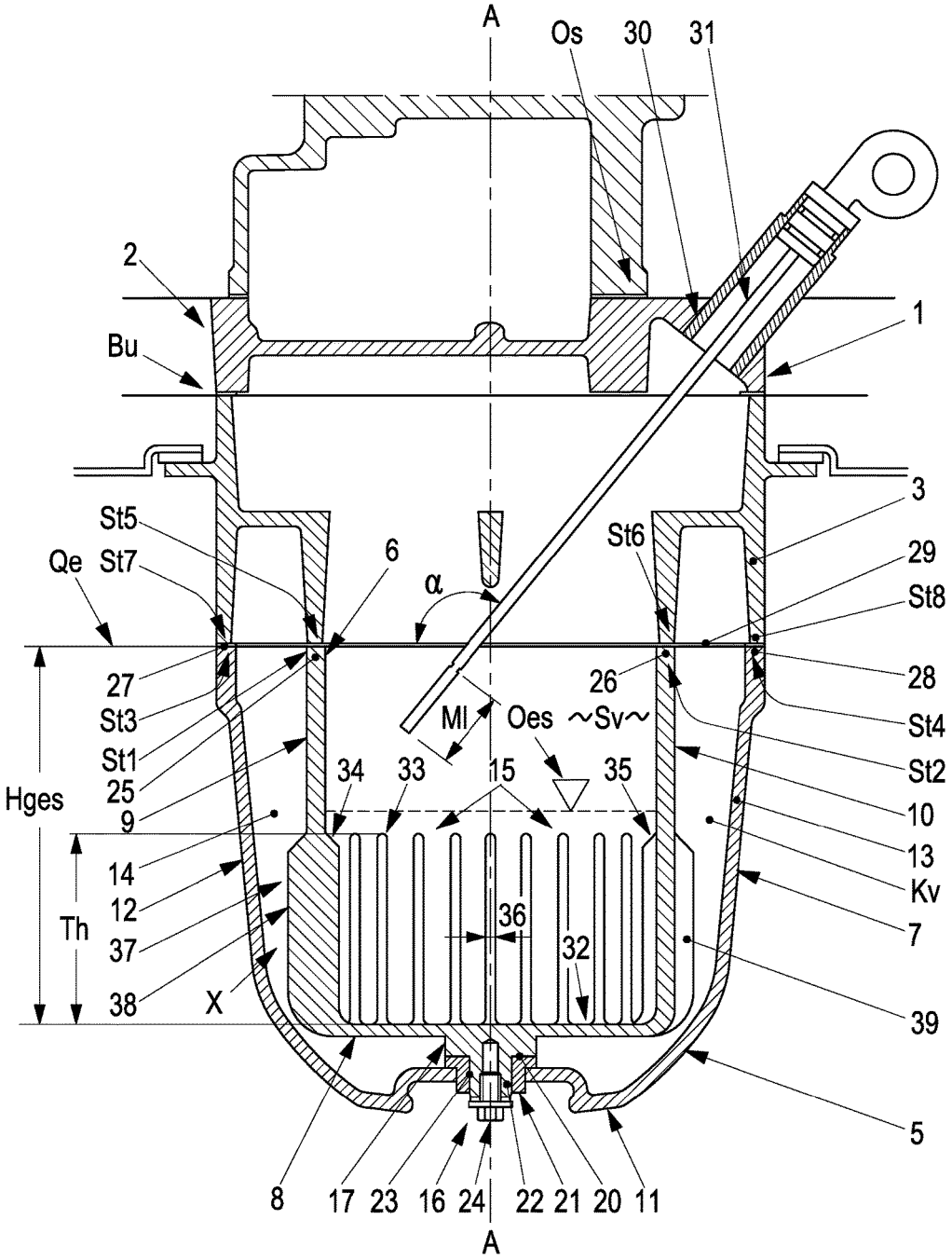
FIG. 1 is a sectional view through an internal combustion engine in the region of a pan system which accommodates a lubricating oil and carries cooling water.
Figure 2:
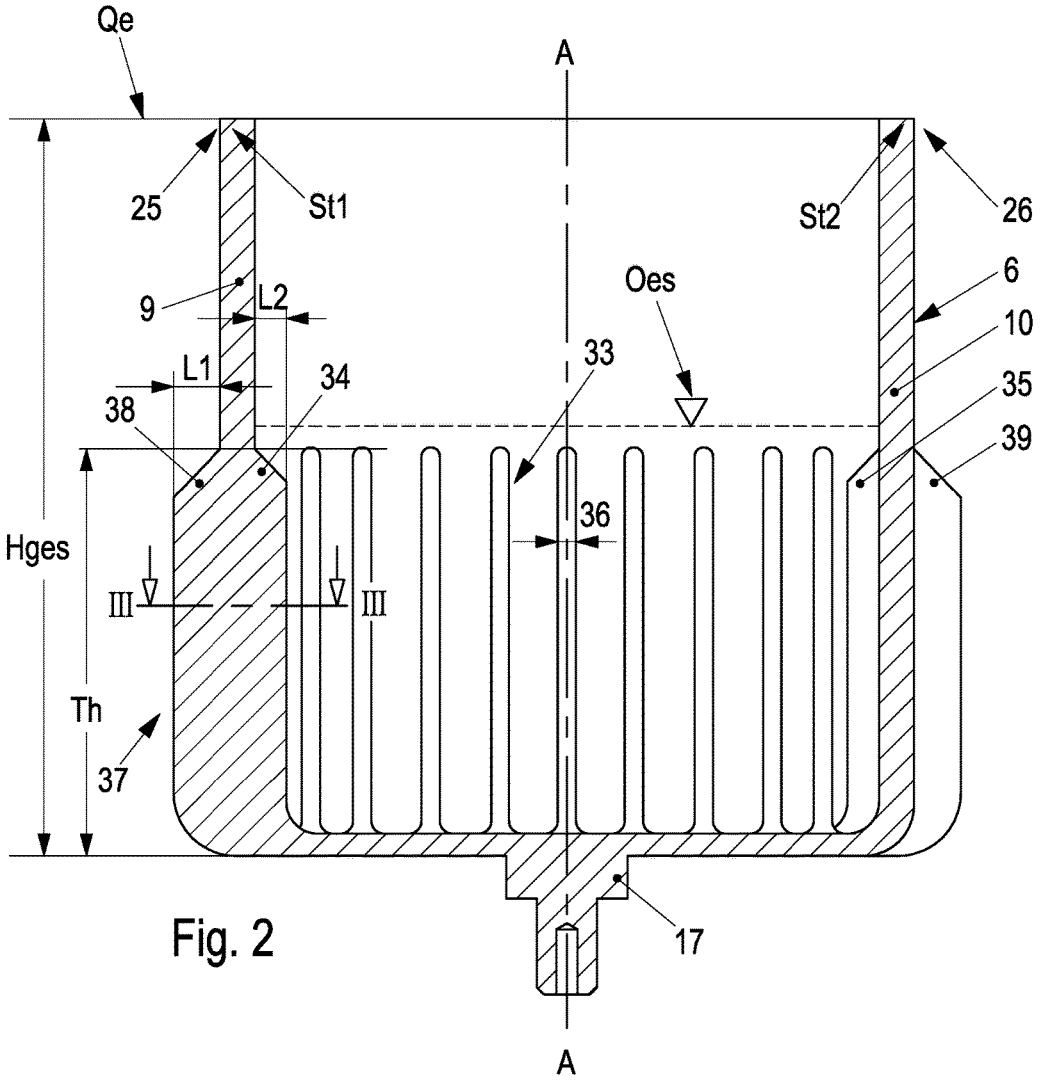
FIG. 2 shows a schematic detail X of FIG. 1.
Figure 3:
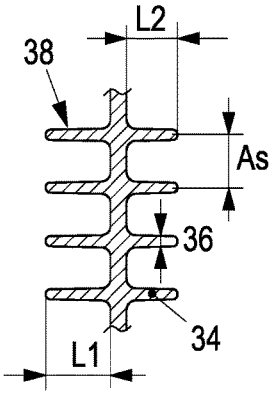
FIG. 3 shows a section according to Line III-III of FIG. 2.

An internal combustion engine 1, which is not shown in detail, includes an engine housing structure 2 which is substantially composed of a cylinder head and a cylinder crankcase—neither of which is shown. In a lower region Bu, the engine housing structure 2 is provided with a connecting housing 3 to which a pan system 5 is connected. The pan system 5 has an inner pan 6, which accommodates a lubricating oil of the internal combustion engine, and an outer pan 7, which are formed in the shape of a trough and placed inside one another and are made of metal, preferably lightweight metal. The inner pan 6 has a bottom 8 and upright walls 9 and 10 which are spaced apart from one another. The outer pan 7 has a bottom 11 and upright walls 12 and 13 which are likewise spaced apart from one another. The bottoms 8 and 11, the walls 9 and 10 and also 12 and 13 run, for example, approximately at a parallel distance from one another, so as to result in an intermediate space 14 for cooling liquid of the internal combustion engine 1 by which the inner pan 6 and the lubricating oil contained therein is cooled. This is assisted by a cooling fin system 15 with which the inner pan 6 of the pan system 5 is provided. In addition, a supporting system 16, which contributes to the constancy of the distances between the bottoms 8 and 11 and the upright walls 9 and 10 and also 12 and 13, is provided between the inner pan 6 and the outer pan 7.

The supporting system 16, which is arranged only locally in a vertical central longitudinal plane A-A, has a mounting bolt 17 which is produced in one piece with the inner pan 6. The mounting bolt 17 rests with a supporting collar 20 on a mounting bush 21 of the bottom 11 and projects with a molded-on guide pin 22 into a hole 23 of the mounting bush 21. An oil drain screw 24 is also integrated into the guide pin 22.

Free ends 25, 26 and 27, 28 of the inner pan 6 and the outer pan 7 are formed as supports St1, St2 and St3, St4 which act together with counter supports St5, St6 and St7, St8 of the connecting housing 4 of the engine housing 3 by means of defined supporting load. A seal 29 is provided between the supports St1, St2 and St3 and St4 and the counter supports St5, St6 and St7, St6. The supports St1, St2 and St3, St4 and counter supports St5, St6 and St7, St8 are bounded by a transverse plane Qe, for example, between inner pan 6 and outer pan 7 and the connecting housing 3. Arranged at a top side Os of the connecting housing 3 is an oil dipstick facility 30, of which a dipstick 31 encloses a defined, obtuse angle $\alpha$ to the transverse plane of the pan system 5. The dipstick 31 is immersed in a lubricating oil volume Sv of the inner pan 6 which is bounded by an oil level Oes. In order that the lubricating oil volume Sv is appropriately cooled for the operation of the internal combustion engine 1, a cooling water volume Kv, which is supplied by a cooling water pump (not shown) of the internal combustion engine 1 and flows around the inner pan 7 in a cooling manner, is introduced into the intermediate space 14 of the pan system 5.

On an inner side 32 of the bottom 8 of the inner pan 6, the cooling fin system 15 has a plurality of bottom cooling fins 33, which are uniformly distributed for example. Wall cooling fins 34 and 35 are likewise formed on the inner side 32 of the inner pan 6, namely on the upright walls 9 and 10. Their arrangement corresponds substantially to that of the bottom cooling fins 33. Furthermore, both the bottom cooling fins 33 and the wall cooling fins 34 and 35 are aligned perpendicular to the bottom 8 and to the upright walls 6 and 7 of the inner pan 6, wherein the average thickness 36 of the latter mentioned fins measures approx. 1.5 to 2.5 mm viewed over their length.

At least one part of the bottom fins 33 extends over a defined partial height Th of a total height Hges of the upright walls 9 and 10 of the inner pan 6 or the pan system 5. In the exemplary embodiment, the partial height Th of the bottom cooling fins 33 extends to the vicinity of the oil level Oes of the lubricating oil volume Sv and can be defined by the product 0.5×total height Hges. Furthermore, at least one part of the wall cooling fins 34 and 35 extends in the direction of the transverse plane Qe, e.g., approximately over the partial height Th of the bottom cooling fins 33.

On an outer side 37 of the upright walls 9 and 10 of the inner pan 6, the cooling fin system 15 includes wall cooling fins 38 and 39. A first length L1 of the wall cooling fins 38 and 39 on the outer side is approx. 12 to 15 mm; a second length L2 of the wall cooling fins 34 and 35 on the inner side 32 of the inner pan 6 is formed by a factor 0.8 to 0.9×L1. Finally, the distance As between at least one part of the wall cooling fins 34 and 35 or 38 and 39, respectively, and the bottom cooling fins 33 is defined by the product 2×L1.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A pan system for an engine housing structure of an internal combustion engine, comprising:

an outer pan having a bottom and upright walls, the outer pan being trough-shaped in cross-section;

an inner pan having a bottom and upright walls, the inner pan being trough-shaped cross-section, wherein the inner pan is arranged inside the outer pan such that the bottom and upright walls of the outer pan extend at least in certain areas at a distance from the respective bottom and upright walls of the inner pan to provide a channel-shaped intermediate space that contains a cooling liquid of the internal combustion engine to affect a temperature of the inner pan, the inner pan accommodating a lubricating oil of the internal combustion engine;

a supporting system through which the inner pan and the outer pan interact, wherein the inner pan and the outer pan are made of metallic material, the inner pan is provided at least on one inner side of the bottom and the upright walls with a cooling fin system configured to optimize heat transfer, the supporting system is effective between the bottom of the inner pan and the bottom of the outer pan, the supporting system including a mounting bolt integrally formed with the inner pan; and a mounting bush on the bottom of the outer pan, wherein the mounting bolt rests on the mounting bush via a supporting collar, and the upright walls of the inner pan and the upright walls of the outer pan are configured for connection to the engine housing structure, wherein the mounting bolt includes a guide pin configured to project into a hole of the mounting bush, the mounting bolt guide pin includes an end face exposed to a region outside of the outer pan, the mounting bolt guide pin is configured to receive an oil drain screw installable into the mounting bolt from outside the outer pan, and the mounting bolt extends from the inner pan into the mounting bush such that there is no leakage path between the inner pan and the outer pan in the intermediate space between the inner pan and the outer pan.

2. The pan system according to claim 1, wherein the cooling fin system is provided at least on an outer side of the upright walls of the inner pan and comprises wall cooling fins.

3. The pan system according to claim 1, wherein the mounting bolt is provided with an oil drain screw.

4. The pan system according to claim 1, wherein free ends of the upright walls of the inner pan and the outer pan are configured as supports that interact with counter supports of a connecting housing of the engine housing structure under a defined supporting load.

5. The pan system according to claim 4, wherein the supports and the counter supports are bounded by a common transverse plane between the inner pan and the outer pan or the connecting housing.

6. The pan system according to claim 1, wherein the cooling fin system includes a plurality of bottom cooling fins, which are uniformly distributed, on an inner side of the bottom, as well as wall cooling fins on the inner side of the upright walls, of the inner pan.

7. The pan system according to claim 6, wherein the bottom cooling fins and the wall cooling fins are aligned substantially perpendicular to the bottom and to the upright walls of the inner pan, respectively.

8. The pan system according to claim 7, wherein at least one part of the bottom cooling fins extends over a defined first partial height (Th) of a total height (Hges) of the upright walls of the inner pan.

9. The pan system according to claim 8, wherein the partial height (Th) of the bottom cooling fins is defined by the product 0.5×total height (Hges) of the upright walls of the inner pan.

10. The pan system according to claim 6, wherein at least one part of the wall cooling fins extends approximately over the partial height (Th) of the bottom cooling fins.

11. The pan system according to claim 10, wherein a first length (L1) of wall cooling fins on an outer side of the upright walls of the inner pan is approx. 12 to 15 mm.

12. The pan system according to claim 11, wherein a distance (As) at least between one part of the bottom cooling fins and the wall cooling fins is defined approximately by the product 2× the first length (L1) of the wall cooling fins on the outer side of the upright walls.

13. The pan system according to claim 12, wherein a thickness of at least one part of the bottom cooling fins and of the wall cooling fins is between 1.5 and 2.5 mm.

14. The pan system according to claim 10, wherein a second length (L2) of the wall cooling fins on the inner side of the upright walls of the inner pan is defined by a factor 0.8 to 0.9× a first length (L1) of wall cooling fins on the outer side of the inner pan.

15. The pan system according to claim 6, wherein a thickness of at least one part of the bottom cooling fins and of the wall cooling fins is between 1.5 and 2.5 mm.

* * * * *